US012746447B2

(12) United States Patent
Lysenko

(10) Patent No.: US 12,746,447 B2
(45) Date of Patent: Sep. 29, 2026

(54) SYSTEM FOR RESTRICTING USER MOVEMENTS IN AN AQUATIC MEDIUM

(71) Applicant: OBSHCHESTVO S OGRANICHENNOI OTVETSTVENNOSTIU "VIARDAIVER" (OOO "VIARDAIVER"), Yekaterinburg (RU)

(72) Inventor: Aleksei Vladimirovich Lysenko, Yekaterinburg (RU)

(73) Assignee: OBSHCHESTVO S OGRANICHENNOI OTVETSTVENNOSTIU "VIARDAIVER" (OOO "VIARDAIVER"), Yekaterinburg (RU)

( * ) Notice: Subject to any disclaimer, the term of this patent is extended or adjusted under 35 U.S.C. 154(b) by 507 days.

(21) Appl. No.: 18/268,044

(22) PCT Filed: Dec. 20, 2021

(86) PCT No.: PCT/RU2021/050443
§ 371 (c)(1),
(2) Date: Jun. 16, 2023

(87) PCT Pub. No.: WO2022/131969
PCT Pub. Date: Jun. 23, 2022

(65) Prior Publication Data

US 2024/0075369 A1 Mar. 7, 2024

(30) Foreign Application Priority Data

Dec. 18, 2020 (RU) ..... RU2020142025

(51) Int. Cl.
*A63B 69/12* (2006.01)

(52) U.S. Cl.
CPC ..... *A63B 69/12* (2013.01)

(58) Field of Classification Search
CPC ... A63B 69/12; A63B 2225/605; A63B 31/00; A63B 2244/20
See application file for complete search history.

(56) References Cited

U.S. PATENT DOCUMENTS 2,434,543 A * 1/1948 Borroughs ..... A63B 69/12 434/254
3,226,114 A * 12/1965 Swider ..... A63B 69/12 434/254

(Continued)

FOREIGN PATENT DOCUMENTS

CN 206715250 U 12/2017

*Primary Examiner* — Steve Rowland

(57) ABSTRACT

A system for restricting user movements in an aquatic medium relates to swimming systems and may be used for virtual reality (VR) simulation systems. By using the system, a swimmer returning force may be produced in response to the swimmer movement in any direction, the effect of presence in a VR may be increased, and requirements to the supporting portion and to the surface area of a zone utilized in a swimming pool may be reduced. The system comprises a flexibly resilient member retaining a swimmer (directly or via an intermediary) and anchored by means of a system of supports. The swimmer movements cause the resilient member to move in its entirety, without being deformed, such that its end elevation varies. The system responds by the resilient member flexing to the swimmer displacement in a horizontal direction. To provide for a vertical freedom, the resilient member is mounted on supports configured to rotate. Alternatively, the resilient member is configured to move translationally. The resilient member may be connected to a swimmer via a module secured on the swimmer's body or hand-held by the swimmer. The resilient member may have a curved shape to prevent it from colliding with the user.

7 Claims, 7 Drawing Sheets

(56) References Cited

U.S. PATENT DOCUMENTS 3,981,500 A * 9/1976 Ryan ..... A61G 7/0533 248/629
4,095,657 A * 6/1978 Hohwart ..... A63B 69/12 434/254
4,247,096 A * 1/1981 Schmitt ..... A63B 69/12 273/DIG. 30
4,524,711 A * 6/1985 Ashrow ..... A63B 69/12 267/74
4,530,497 A * 7/1985 Moran ..... A63B 69/12 434/254
5,083,522 A * 1/1992 Ashrow ..... A63B 69/12 114/215
5,391,080 A * 2/1995 Bernacki ..... A63B 69/12 434/254
5,846,167 A * 12/1998 Liu ..... A63B 69/12 482/111
6,247,935 B1 6/2001 Martin et al.
7,175,569 B1 * 2/2007 Lan ..... A63B 21/4009 434/254
7,185,598 B1 * 3/2007 Lan ..... A63B 69/12 114/215
7,442,151 B1 * 10/2008 Berdegue ..... A63B 69/12 434/254
10,343,753 B1 * 7/2019 Santa-Torres ..... G08B 21/02
11,097,177 B1 * 8/2021 Fuller ..... A63B 69/125
2005/0215398 A1 * 9/2005 Lan ..... A63B 69/12 482/55
2007/0060452 A1 * 3/2007 Chang ..... A63B 69/12 482/55
2009/0298652 A1 12/2009 Lessard
2010/0009813 A1 * 1/2010 Mayaud ..... E04H 4/0025 482/55
2011/0136629 A1 * 6/2011 Bellerive ..... A63B 31/00 482/55
2014/0155227 A1 * 6/2014 Bellerive ..... A63B 69/12 482/55
2015/0290517 A1 * 10/2015 Saleh ..... A63B 69/12 434/254
2020/0226946 A1 * 7/2020 Lysenko ..... G06F 3/011
2025/0129627 A1 * 4/2025 Hughes ..... E04H 4/14

* cited by examiner

SYSTEM FOR RESTRICTING USER MOVEMENTS IN AN AQUATIC MEDIUM

TECHNICAL FIELD

The invention relates to swimming systems and may be used in training, recreational or rehabilitation swimming systems, including, inter alia, virtual reality simulation systems. The claimed system is intended primarily for snorkeling, i.e. swimming underwater while equipped with a mask and a breathing tube, but may also be used for other types of user (swimmer) movements in an aquatic medium.

BACKGROUND ART

There is known a system for controlling a virtual object [WO2019027358A1, published 7 Feb. 2019, with priority as of 31 Jul. 2017 from RU2017127259A, A63F13/428; G09B9/00] by efforts applied by a user with the aim of moving a physical body associated with the virtual object, the physical body being secured by a system of tethers such that the tethers retain the body in a position of stable equilibrium, the body being able to rotate around an axis passing close to the body center. There is described a physical principle of the system operation to measure the effort applied by a swimmer, which may be used to simulate the swimmer's avatar movements in a virtual space. Two main uses of the systems are addressed: to simulate diving and to simulate snorkeling.

Applying the system operating principles to snorkeling is different from applying them to diving due to physical constraints on movements of a swimmer in the real world. When diving, a swimmer is free to move relative to any of the three reference axes, while when snorkeling the swimmer movements are restricted to swimming along the water plane, i.e. to a two-dimensional space. As such, the vertical component of the force measured by a controller on the swimmer body is not normally related to the user's swimming intent, but depends on particular features of the system used to secure the user in the swimming pool.

For example, where a user is secured with a tether installed above a swimming pool, when the user departs from the swimming zone center, he/she moves about a sphere with a radius equal to the tether length. In response to his/her departure from his/her equilibrium position, the depth of his/her submersion in water varies. In response to a certain departure from the equilibrium position, the user body starts floating upwards from the water, the Archimedes force decreases with a corresponding increase in the action on the tether, and the vertical component of the tether tension increases, resulting in a stable equilibrium. The swimmer cannot intentionally vary the vertical component of the force other than by diving down and thereby stopping the air supply through the snorkel, which is undesirable for virtual reality systems. Any variation to the contrary (i.e. swimming upwards) is practically impossible due to the inability to take a diagonal body posture.

In view of the above, a snorkeling simulation may ignore the vertical component of the measured force and may be limited to the horizontal component measurement.

As such, the vertical component of the force so arising does not cause any significant problems for simulation calculations. However, in case of active swimming, said component can produce a disadvantageous effect directly to the swimmer. If the swimmer is secured by a tether arranged at a low level, he/she may be dragged to under the water surface rather strongly, which will result in a change of the body tilt angle (a user body departure from the horizontal posture, with the swimmer's belt being dragged to a large depth), and, at an extreme depth, in problems with breathing through the snorkel (the swimmer's head also being dragged to a large depth). Where the tether is anchored at a high point, the above problem is not so acute, as, when the user is swimming, the tether is pulling him/her upwards. In such event, the body first adopts a more horizontal posture under the water, which normally does not prevent swimming, and, when the body is pulled out to above the water surface, the Archimedes force decreases, resulting in effective resistance to further pulling out.

As such, implementation of a snorkeling system with a swimmer restrained by an overhead tether is preferable and provides sufficient comfort for a user who applies low swimming efforts. However, if moderate or high swimming efforts are applied, the swimmer being pulled out to the water surface and the tether being tensioned result in a decrease in the effect of presence in a virtual reality, the decrease consisting in a heterogeneity of physical sensations when going through homogenous areas in a virtual space. For example, when changing the movement direction while swimming in a physical space near the equilibrium point, the tether tension is minimal, and the user gets sensations close to the sensations from free swimming. In case of active swimming, shortly after such area, the swimmer departure from the equilibrium position reaches its maximum, resulting in a fairly sharp increase in the tether tension diagonally upwards and in a change in the swimming state due to an increased support provided to the body by the restraint system. Physical jerking sensations, as well as heterogeneity of sensations when changing the movement direction, do not receive any reinforcements in the virtual space, which results in a decreased presence effect. The above disadvantageous effects can be mitigated by increasing the tether elasticity; however, in that case, the physical swimming region radius (the swimming pool size) would have to be increased accordingly, thus making the system less cost efficient.

The objectives related to retaining a swimmer within a certain swimming zone are addressed by the prior art systems developed for training swimmers or for teaching to swim. Specifically, they are directed to solving such problems as keeping a swimmer at a certain depth, while preventing him/her from involuntarily going under water, if the swimmer has poor swimming skills, and at reducing the required swimming zone (swimming pool length), primarily by providing for stationary swimming Such systems represent devices that produce a water current counteracting the swimmer movement or a system of tethers holding a swimmer stationary, while buoying up the swimmer at a certain depth and in a certain direction. They normally include a support that bears an element designed to retain the swimmer either directly, or via intermediaries. That is to say, one end of the retaining member is connected to a swimmer and the other end is attached to the supports at the pool sideboard (CN206616898U, U.S. Pat. No. 7,185,598B1, US2010009813A1, U.S. Pat. Nos. 4,527,795A, 7,442,151B1, 4,109,905A, 4,530,497A, etc.) or is retained at a bank by means of a heavy weight container (U.S. Pat. Nos. 5,816,982A, 4,962,923) or a portable anchoring device (US2020122812A1, U.S. Pat. No. 5,244,393A, WO2017034939A1).

U.S. Pat. No. 7,185,598B1 discloses a swim training apparatus comprising a carrier-mounted resilient element (e.g., in the form of a spring) enclosed in a housing to which a resilient rope is attached, the rope being configured to be connected to a user. The swimming device according to US2010009813A1 comprises an elastically stretchable holding cable (resilient cord, resilient belt) configured to be connected to a swimmer, which, at its other side, is connected to a holding rod. The apparatus according to U.S. Pat. No. 7,273,444B2 comprises a suspension member configured as an elastic tube having disposed inside it a restraining cable, wherein the cable may be less elastic than the tube and is adapted to restrain extension of the elastic tube; wherein the suspension member is connected to a carrier such as to be movable along the carrier.

Thus, in the prior art devices, the member directly connected to a user is a tether, i.e. a tensile and highly resilient member. However, using a tether may be associated with various problems. As such, a tether is unable to retain spatial orientation and just restricts movements of its end connected to a user. In case of pendulous deflection, the tether does not produce a returning force, but just deflects, while the returning force results from the action of gravity or buoyancy. The returning force will not act on a moving body, which is suspended by the tether in water and neutrally buoyant, until buoyancy of the body decreases in response to a certain departure and floating up of the body from the water. The neutral buoyancy will be lost, and the body will start sinking back in the water. In a certain cone-shaped region under the rope, no forces are acting on the body; therefore, the body is free floating. In response to a departure, forces start to act depending on the rope radius; such action can be rather sharp.

Furthermore, one the main objectives of swimmer retaining systems is to provide a reliable tether anchoring point capable of withstanding the forces exerted by the swimmer, for example, above the swimming pool swimming zone center. In the prior art systems, this objective is achieved as follows:

by attaching the tether directly to the swimming pool side-board, thus restricting movements only in the direction away from the swimming pool side-board (U.S. Pat. Nos. 5,816,982A, 4,109,905A, 4,527,795A);

by utilizing systems having a counteracting lever, which do not require a large attachment base; however, such systems also act in a single direction away from the side-board (U.S. Pat. No. 7,442,151B1);

by using rigid carriers having an attachment base sufficient to prevent the carrier from rolling over and secured either by means of a heavy weight at the base, or via the points where the base is fixedly anchored to a floor, or by other methods, the carrier anchoring requirements substantially increasing with an increase of the distance between said point and a bank to approximately two meters, as is required to accomplish the objective to be solved (U.S. Pat. Nos. 7,185,598B1, 5,244,393A, 7,175,569B1, 4,247,096A);

by using an opposite side-board or various side-boards of the swimming pool (CN206616898U, U.S. Pat. No. 5,192,256A), or a wall/a ceiling of an indoor space, which is suitable for fixed-size swimming pools, such as framed swimming pools, but not well suitable for swimming pools of variable sizes and configurations, specifically, for large swimming pools.

A resilient pole may be used as a supporting carrier (U.S. Pat. No. 4,530,497A), for example, a fiber glass pole, to which a tether (a cable) is connected. The device is configured to provide an upward force A that approximates the planing force that holds a swimmer on the water surface. At the same time, the rearward holding force B keeps the swimmer in a certain area. A similar approach is used in an exercise device according to U.S. Pat. No. 7,563,206B1, wherein, by using a resilient bearing member, a lifting action is provided to the swimmer while in the body of water.

Most solutions used as supports are bulky, difficult to install systems with low mobility. Problems also arise in relation to the system's supporting portion installation process. Swimming pools and water bodies have different sizes, structural features and other characteristics constraining installation of supports. With complex fastener systems, the choice of water bodies suitable for using the system is limited.

The prior art swimmer retaining systems provide for a swimmer to be resiliently secured and to be able to move in one direction. When the swimmer turns and moves back to the bank, such systems are unable to perform the function of retaining and confining the swimmer within a certain space. The prior art systems do not, therefore, solve the problem of the swimmer movement restriction in all directions within a certain selected area.

The invention is directed at solving the following technical problems:

- disadvantageous effect of a vertical force from the attachment system, which is responsible for a decreased effect of presence and heterogeneity of the user sensations when using the systems to simulate a virtual reality;
- operability of the prior art systems in a single swimmer movement direction;
- utilization of a large-size area for swimming;
- bulky, difficult to install structures used to create a bearing point;
- limitations related to swimmer pool sizes, shapes and other characteristics to be factored in when selecting the support.

SUMMARY

The claimed invention provides for creating a force that returns a user (swimmer) to a certain swimming zone, when the user is moving along the water surface, i.e. away from a swimming pool side-board and back thereto. The action exerted by the system on the user along the vertical axis is reduced and does not depend on the swimmer departure from the equilibrium position. Furthermore, the effect of presence sensed by a user when using the invention in virtual reality simulation systems is increased, and the requirements to the claimed system's supporting portion are reduced.

The claimed system for restricting user (swimmer) movement in an aquatic medium comprises a flexibly resilient member, having a first end (retaining end) designed to be connected to a swimmer, and a second end (retained end) designed to be anchored by means of a system of supports. Herein, the swimmer retaining member generates a returning force and defines a swimming zone around itself.

The system is arranged such as to allow the resilient member to move in its entirety, without being deformed, in such a manner that the retaining end elevation varies within a natural variation range of the user position depth when swimming along the water surface. The entire resilient member moves without being deformed, its position varying in such a manner that its retaining end position varies in a vertical direction in accordance with the swimmer movements. The swimmer has, therefore, a degree of vertical freedom and in that direction is not subjected to the returning force caused by the resilient member deformation. As a result, the system provides for a homogeneity of sensations to the swimmer, as it neither drags the swimmer to under the water surface, nor draws him/her forcefully from the water in response to approaching the swimming zone edge. In fact, the system does not restrict vertical movement of the swimmer when swimming along the water surface.

Furthermore, the resilient member must be installed such that any substantial displacement of the swimmer in any horizontal direction would cause the resilient member to flex. That is, the resilient member responds to a user movement along the water surface by flexing, rather than, for example, by stretching, as in the prior art systems. When the swimmer changes its movement direction (turns to another direction or backwards), the system continues to perform its function, i.e. to retain the swimmer in a certain swimming zone, by producing a returning force acting on the swimmer.

Preferably, when the resilient member retaining end is moving in a vertical direction without being deformed, the entire resilient member is either moving in the vertical direction, or does not substantially change its spatial orientation. In that case, the retaining member providing returning forces in all horizontal directions at the same user position depth, having moved upwards in parallel or nearly in parallel in response to a depth variation, will retain the uniformity of the returning forces for all horizontal directions. Furthermore, when the entire retaining member moves in a vertical direction, horizontal coordinates of its retaining end remain unchanged, which means that the depth variation occurs without shifting the user, and that the horizontal coordinates of the simulation area center location, to which the system returns the user, remain the same irrespective of the depth.

The user freedom in a vertical direction (for depth variation) may be obtained, for example, by disposing a system of supports on a bearing surface so that the supports can rotationally move about an approximately horizontal axis distant from the swimming zone center. Freedom of a support rotation about said axis is transmitted to the resilient member, allowing the latter to circumferentially move in a vertical plane, thus causing the supporting member retaining end elevation to vary. Preferably, the resilient member retained end is fixedly connected to the ends of two inclined supports having their opposite ends anchored at spaced apart points distant from the swimming zone center. Moreover, the system of supports and the resilient member are configured to rotate relative to a straight line passing through the support anchoring points.

Alternatively, the resilient member and the swimmer vertical mobility may be provided by configuring the resilient member to translationally move along an approximately vertical axis. Preferably, the resilient member is slidingly coupled to a system of at least two supports resting on distinct points distant from the swimming zone center.

The resilient member may be connected (coupled) to the swimmer via a module secured on the swimmer's body or hand-held by the swimmer. To prevent the swimmer head from colliding with the resilient member, when he/she is holding the module in his/her hands, the resilient member may be curved away from the swimmer head at an area corresponding to the swimmer head level and be configured to freely rotate about an approximately vertical axis.

Furthermore, the resilient member may be connected to the swimmer via an intermediary element providing for the swimmer rotational mobility about the resilient member.

Preferably, the system is used for virtual reality simulation systems, thus making it possible to reduce the impact of undesirable forces on the user and to increase the effect of presence. The horizontal force acting on the swimmer, when his/her motion direction is changed and when he/she is moving near the point of equilibrium, varies more smoothly. Homogeneity of senses when departing from the equilibrium position is improved by providing more uniform distribution of the vertical load on the user, i.e. the load not dependent or dependent to a small extent on horizontal displacements of the swimmer.

The claimed system features the following capabilities:

- it restricts horizontal displacement of a swimmer in any direction relative to a central point by producing a returning force in response to the user departure from a predefined area;
- it does not restrict or restricts to a minor extent, as compared with the restriction in a horizontal direction, the swimmer movement in a vertical direction relative to the water surface.

BRIEF DESCRIPTION OF THE DRAWINGS

FIG. 1 shows a version of the system comprising a single support;

FIG. 2 shows dynamic behavior of the system when a swimmer is moving upwards (hereinafter, the thicker arrows indicate departure directions of the system components in response to the user actions);

FIG. 3 shows the system behavior when the swimmer is moving towards a side-board of a swimming pool;

FIG. 4 shows the system behavior when the swimmer is moving away from the swimming pool side-board;

FIG. 6 shows a fixedly anchored support with a sufficient bearing base;

FIG. 7 shows two supports fixedly anchored opposite each other, wherein the resilient member is translationally movable in response to horizontal movement of a swimmer;

FIG. 8 shows two supports fixedly anchored opposite each other, wherein the resilient member is translationally movable in response to vertical movement of a swimmer;

FIG. 9 shows a preferred implementation utilizing three arcuate structures secured at side-boards of a circular framed swimming pool;

FIG. 11 shows a resilient member in the form of a C-shaped carrier;

FIG. 12 shows a trapezoidal resilient member;

DESCRIPTION OF EMBODIMENTS

Figure 1:
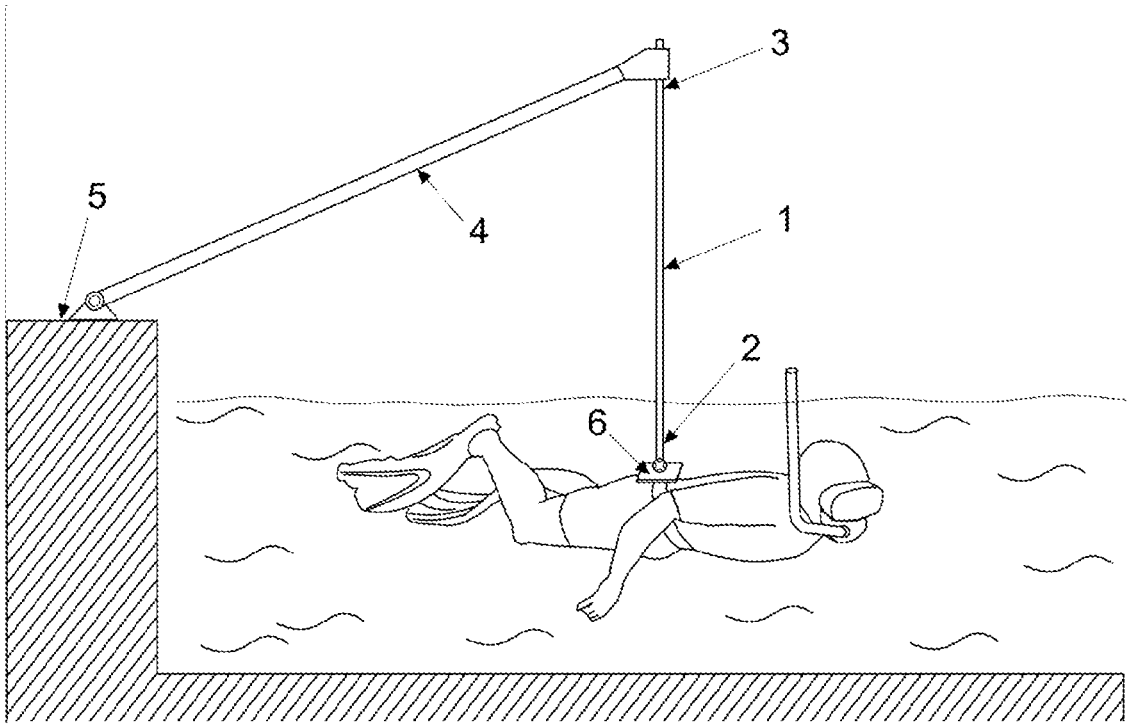
FIGS. 1 to 4 show a first embodiment, comprising a hingedly attached support.

A movement restriction system allows retaining a user (in particular, a swimmer) within a certain area of an aquatic space (a swimming zone, a simulation area) by means of a flexibly resilient member 1. Herein, the term 'swimming' should be understood to mean any activity of the user in the aquatic medium, wherein the user applies efforts that may cause him/her to move.

The resilient member 1, at its first end (a retaining end 2), is connected to the user, and, at its second end (a retained end 3), is anchored at a system of supports (ref. to FIG. 1), for example, above or under the water surface. A system comprised by a single supporting member 4 or several supporting members 4, interconnected and anchored at a bearing surface 5, and the bearing surface as such, i.e. a swimming pool side-board, bottom or ceiling, may be utilized as the system of supports for the resilient member 1.

The retained end 3 must be anchored such that any substantial displacement of the swimmer in any horizontal direction would cause the resilient member 1 to flex. That is, for any retaining end 2 position depth, there is a region in a horizontal plane at its position depth, the region being disposed such that any exit of the retaining end 2 beyond that region causes the resilient member 1 to flex. Thus, the resilient member 1 responds to a horizontal displacement of the swimmer by flexing, rather than by stretching. In contrast to a system utilizing a tether, no force dragging the swimmer out of the water or to under the water is produced in response to a departure from an equilibrium position.

For any retaining system, an area may be defined, which a user should not exit; however, a certain displacement of the user within that area is normally allowable. In many cases, the swimming zone dimensions and shape are determined by the swimming pool dimensions and shape; moreover, there may be physical obstacles outside that area, such as a side-board of the swimming pool, and the user should be prevented from contacting them. As such, in response to a displacement of the user (and the point at which the system is secured on his/her body), which may lead to the user contacting the physical obstacles or any portion of the user body (in most cases, an outstretched arm of the user) exiting the designated swimming zone, the anchoring system should produce a returning force preventing any further displacement. Any departure causing a risk of the user exiting the swimming zone is herein referred to as a 'substantial departure from the swimming zone center'. Indeed, in case of a substantial displacement, a returning force must be produced for the system to perform its retaining function. It should be noted that, in practice, where the swimming zone is defined for a wide range of users of different heights, arm lengths and physical qualities, the system should normally produce a sufficient returning force before the user displacement becomes substantial.

The resilient member 1 may be connected to the swimmer such as to allow him/her (the swimmer) rotate about a vertical axis separately or together with the resilient member 1. The connection to the swimmer may be of a hinged or a flexible type and may include using a short flexible intermediary element (for example, made of a rope or rubber) or other prior art joint providing for rotational mobility of the swimmer at the resilient member 1 attachment point within a range sufficient for the swimmer to freely swim.

The system is arranged such as to allow the resilient member 1 to move in its entirety without being deformed (for example, stretched). Such movement causes the retaining end 2 elevation to vary relative a selected horizontal surface, for example, the swimming pool bottom, i.e. the retaining end is displacing in a vertical direction. The displacement occurs at least within a natural range of variation of the depth at which the swimmer is positioned when swimming along the water surface. However, the retaining end 2 should not move or should move only to a minor extent in a horizontal direction in response to a depth variation. Otherwise, in case of a depth variation, the user would sense, from the retaining end 2, a horizontal pressure not associated with the user swimming activity; furthermore, the swimming zone center will have different horizontal coordinates at different depth, which is pointless for swimming pools having vertical walls.

Given the resilient member 1 vertical freedom, the system's bearing points are not required to bear the swimmer weight; moreover, in an implementation where the supports are rotatable about a horizontal axis, they are not required to bear the major portion of the overall system weight, since it 'bears' upon the water, the swimmer, and a buoyancy member. In this way, requirements to the system anchoring at a bank may be significantly reduced. It is sufficient to restrict the system movement at the bank and to restrict movements of the ends caused by small forces. Since the system is unresponsive to the swimmer weight, it does not produce any destructive effect on the system; the swimmer weight action is not transmitted to the system, thus further reducing the requirements to the system supports.

For virtual reality systems, a minimum restriction of the swimmer activity is preferable. The claimed system acts on a swimmer in a more uniform manner; it does not prevent him/her from diving, does not 'drag' him/her from the water or to under the water, thus not producing any excessive effect not reinforced, visually or otherwise, in the virtual reality, thanks to a reduced disadvantageous effect of the force's vertical component.

In the systems utilizing tethers, the vertical component of the force, exerted on a swimmer by the system, increases with an increasing swimmer departure from the swimming zone center. Said disadvantageous effect is associated with the vertical component heterogeneity. In systems where a user is fixedly anchored at a certain depth, when the system is rapidly dampening the vertical component of the forces (in particular, sharp forces) of the user movements, such vertical effect produces a sensation of a restriction being imposed.

When swimming naturally, in response to outward forces produced by the user legs, arms and trunk, to a displacement of the center of mass due to arm and leg movements, and to buoyancy variations due to breathing, a vertical force component is inevitable produced. That is why, in the absence of restrictions, even when swimming along the water surface (without intentionally diving down), the position depth of any point on the user body varies within a certain range, herein referred to as the point's natural swimming position depth variation. Specifically, a user body point at which the retaining system is attached tends to vary its position depth.

Furthermore, by acting against such depth variation, the retaining system destroys the sensation of natural swimming, produces a fixed stop sensation, and prevents the body from taking a posture relative to the water surface, which it would have taken, if swimming naturally.

The claimed system eliminates said disadvantageous effect by minimizing the vertical component of the force produced by the retaining system, for example, by providing a vertical freedom of movement of the point of the system attachment to the user body at least within the range of its position depth variation when the user is natural swimming along the water surface. The range of this point natural displacement in natural swimming is referred to herein as the range of the natural user position depth variation.

Tests of claimed system, in combination with virtual reality simulation systems, have demonstrated that, in contrast to the devices utilizing tethers (ropes, cables or other elements that respond by stretching to a movement), the swimmer sensations become more homogenous and more as expected, thus increasing the effect of presence in a virtual reality. Where tethers are used as a retaining member, the user feels the tether tension, feels that his/her spatial movements are restricted, that it is impossible, for example, to reach the swimming pool side-board. Users of the claimed system report that they do not feel any restriction, such that they no longer understand the real distance to the swimming pool side-board.

The resilient member 1 is the main component providing a smooth return of a swimmer to the swimming zone center. It may be a rod of a necessary length. The resilient member 1 is made of material allowing it to recover its original shape following flexural deformation in conditions of horizontal mobility under a force expected from a user. Owing to its resiliency, the member 1 provides the system restoration to a central position of equilibrium upon release of the swimming forces. The resilient member 1 may be made, for example, of fiberglass, carbon fiber reinforced plastic, metal.

Resiliency of the member 1 may be selected based on the swimming pool dimensions (a desired swimming zone surface area) and the nature of the swimmer efforts. In cases of smaller dimensions and/or more athletic style of swimming, said member may be more rigid. In cases of large swimming pools and/or relaxed swimming, the rigidity may be lowered. Such adjustment may also be done through increasing or reducing the resilient member 1 effective length by varying the position of the point where the resilient member 1 is connected to the supporting members 4. By increasing the resilient member 1 length or by reducing its rigidity, loads on the swimmer body attachment point may be mitigated due to a large radius of the swimming zone; conversely, by reducing the resilient member 1 length or by increasing its rigidity, the horizontal coordinates of the body position in the swimming pool may be made almost completely fixed, thus significantly reducing the size of the zone sufficient for swimming, which is relevant, for example, in cases where the system is installed in small framed swimming pools having a radius of 3 to 4 m.

The resilient member 1 retaining end 2 vertical mobility may be obtained by providing for the resilient member 1 translational mobility along an approximately vertical axis in response to a swimmer motion.

Furthermore, to provide for the vertical mobility, the supporting member 4 may be installed to rotationally move about an approximately horizontal axis distant from the swimming zone center. In this way, load is removed from the system supporting portion (the system attachment points at the bearing surface), they do not have to bear their own weight, which is important in cases of long, heavy and bulky supports.

The term 'distant from the swimming zone center' with reference to the system members, points or axes should be understood to mean that they are disposed at a certain distance from the point of equilibrium corresponding to the swimmer position when the resilient member is not deformed. Where an aquatic space is used in an optimal manner, said distance is usually comparable with the swimming zone radius, so the support anchoring points, being positioned outside the swimming zone, do not create any obstacles for a user. The anchoring points may be disposed near the swimming pool along its perimeter, i.e. in the vicinity of the water boundary, of the water—bank/swimming pool side-board interface area, or, if used in an outdoor body of water, at other mobile or stationary object (a pier, a motor boat, etc.). For example, at the swimming pool handrails, side-boards, floor, walls, etc. Furthermore, they may be disposed at various elevations: above the water level or below the swimming pool floor level; that is, where reference is made to a position 'near', it may indicate either a vertical, or a horizontal displacement relative to the water surface.

The terms 'approximately vertical axis' or 'approximately horizontal axis' should be understood to mean that a member may be disposed either on the respective, i.e. horizontal or vertical, axis, or on an oblique axis close to it. Furthermore, it is preferably disposed closer to said axis or on it, while any deviation is only allowable as long as a sufficient uniformity of the produced load is provided for.

A rigid or a hard elastic supporting member 4 may be used as the support. In that case, at least one supporting member 4 is connected, at its first end, to the bearing surface 5 and, at its second end, to the resilient retaining member 1. The connection may be rigid or may allow the resilient member 1 to rotate and/or shift along an approximately vertical axis.

The supporting member 4 must be strong and rigid enough to prevent substantial horizontal displacement of the point, where the supporting member 4 is connected to the resilient member 1, under the action of the swimming forces produced by the swimmer, wherein the displacement is substantial in comparison with the swimmer horizontal displacement. The supporting member 4 may be resilient to a certain extent. However, the rigidity of a single supporting member 4, for example, attached to a swimming pool side-board, bottom or ceiling, must be much higher than that of the resilient member 1. Where two supporting members 4 are utilized, for example, those resting upon the same side-board of the swimming pool such as to form a triangular structure, their rigidity may be lower in view of a higher rigidity of the structure. Even less rigid supporting members 4 may be used in case where three or more supporting members 4 form a pyramid- or a dome-like structure, for example, resting upon distinct sides of the swimming pool. The supporting members 4 may be comprised of, for example, tubes made of an aluminum alloy, fiberglass or carbon fiber reinforced plastic. For ease of storage and transportation, the supporting members 4 may be constructed from assemblable shorter elbows.

The system's geometry is such that its components do not prevent free swimming in any direction. Specifically, where the system is anchored above the water surface, elevation of the supporting members 4 above the surface must be sufficient for a snorkel tube to freely pass below them when a swimmer is making turns. Where disposed under water, the supporting members 4 must be disposed in an area in which they would not be touched by the swimmer's legs.

The system may be implemented in various ways.

In a first embodiment, a connection between the supporting member 4 and the bearing surface 5 is selected such as to allow it to rotate about a horizontal axis passing through a point/points of connection to the bearing surface 5. For example, the supporting member 4 may be anchored via a hinged connection. Since the system is not intended to restrain the swimmer movement in a vertical direction, there is no need to provide a support in that direction. The opposite end of the hinged supporting member 4 is movable in a vertical plane and may, together with the resilient member 1 and the swimmer, freely move in a vertical plane around a large-radius circumference determined by the supporting member 4 length, thus allowing the swimmer position depth to freely vary in response to any departure of the swimmer from the zone center. The larger the distance between the swimming (simulation) zone center and the horizontal axis (the longer the support), the larger the circumference radius and the closer to vertical is the movement of the resilient member 1 retaining end 2. In this case, the vertical load exerted on the swimmer belt by the carrier (supporting member 4) is determined by the supporting member 4 weight and is essentially independent of the magnitude of swimmer departure from the equilibrium position.

The support (supporting member 4) weight may be offset by providing additional buoyancy, for example, by arranging buoyancy elements at the swimmer belt or at the supporting member 4 end.

Figure 2:
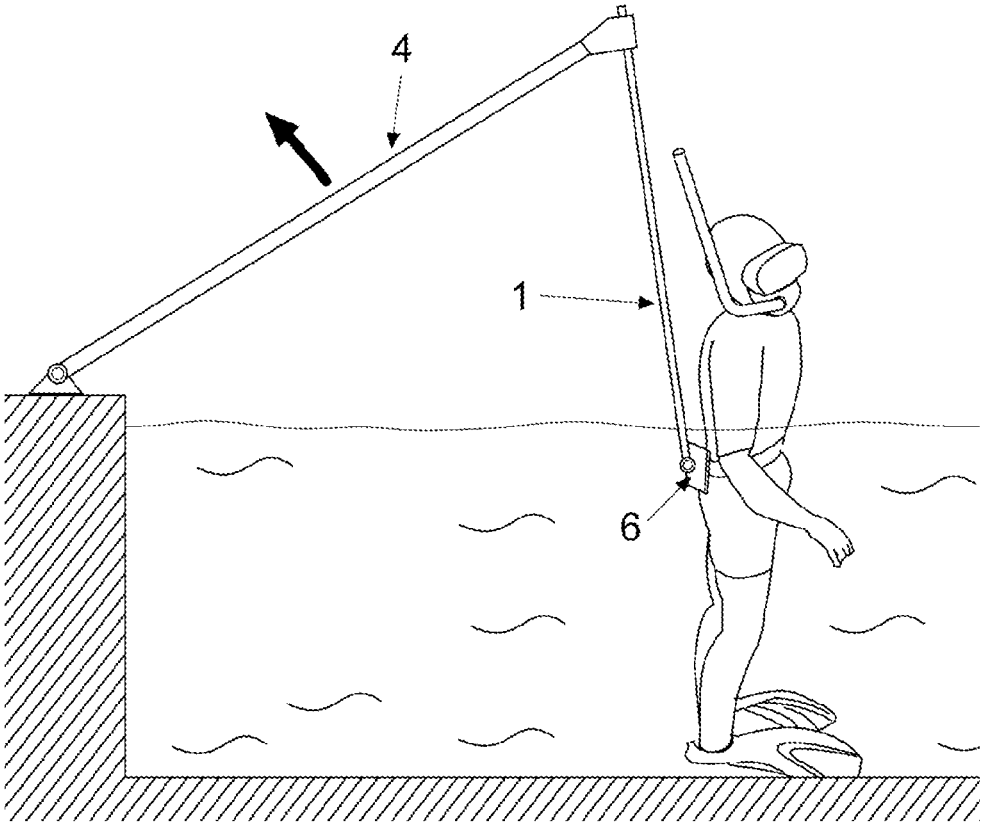
Figure 3:
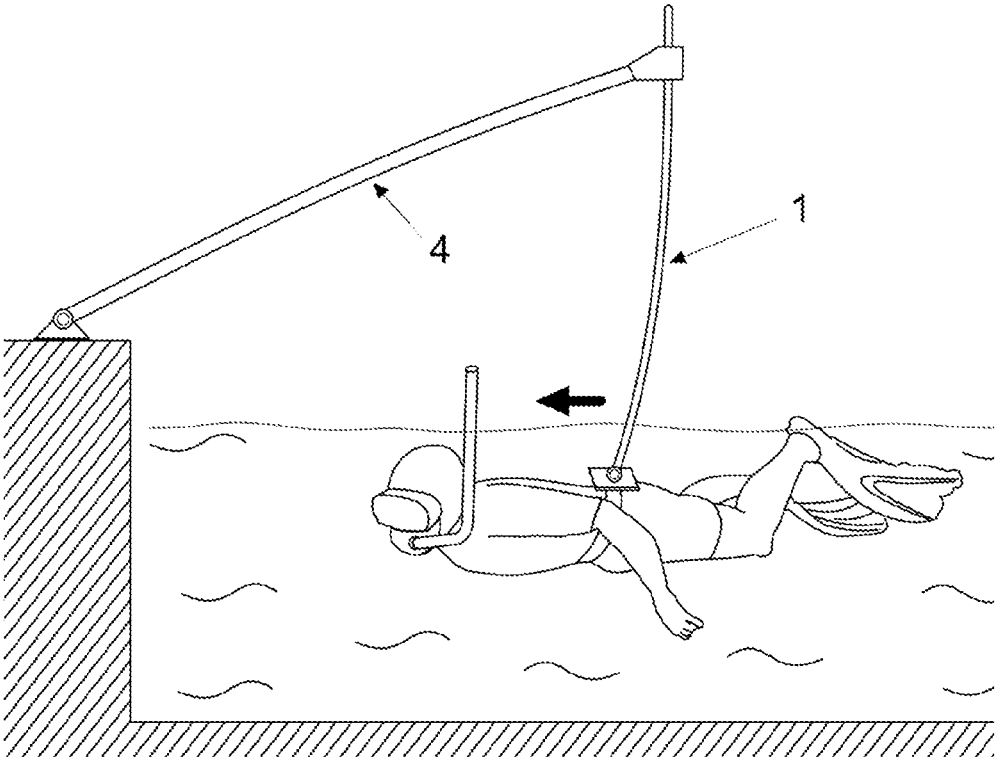
Figure 4:
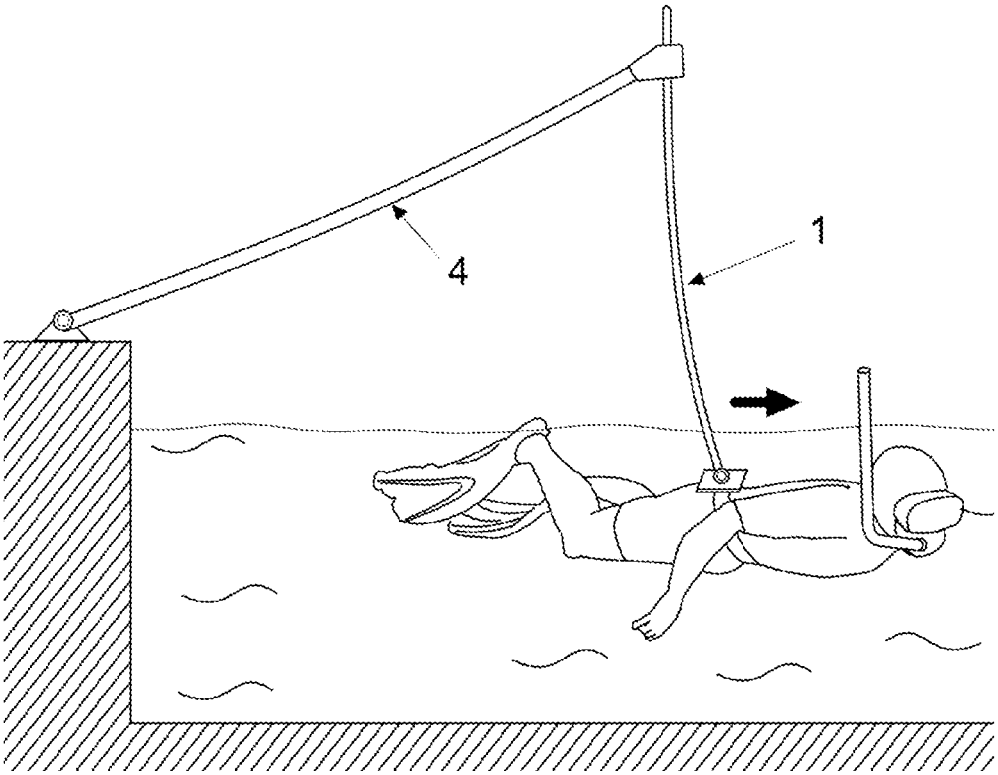

One way of implementing the system according to the first embodiment is shown in FIG. 1. Herein, a supporting member 4 (a carrier) is anchored via an axial hinge at a bank (at a swimming pool side-board). The carrier is shaped such as to allow a swimmer to freely swim below it without striking a snorkel against it, while the retaining member 1 resiliency allows returning the swimmer into an initial central position in the swimming pool, if the swimmer departures from it. Furthermore, the system allows the swimmer to move in a vertical direction (FIG. 2) and remains operable when the swimmer turns backwards (FIG. 3, FIG. 4).

Figure 5:
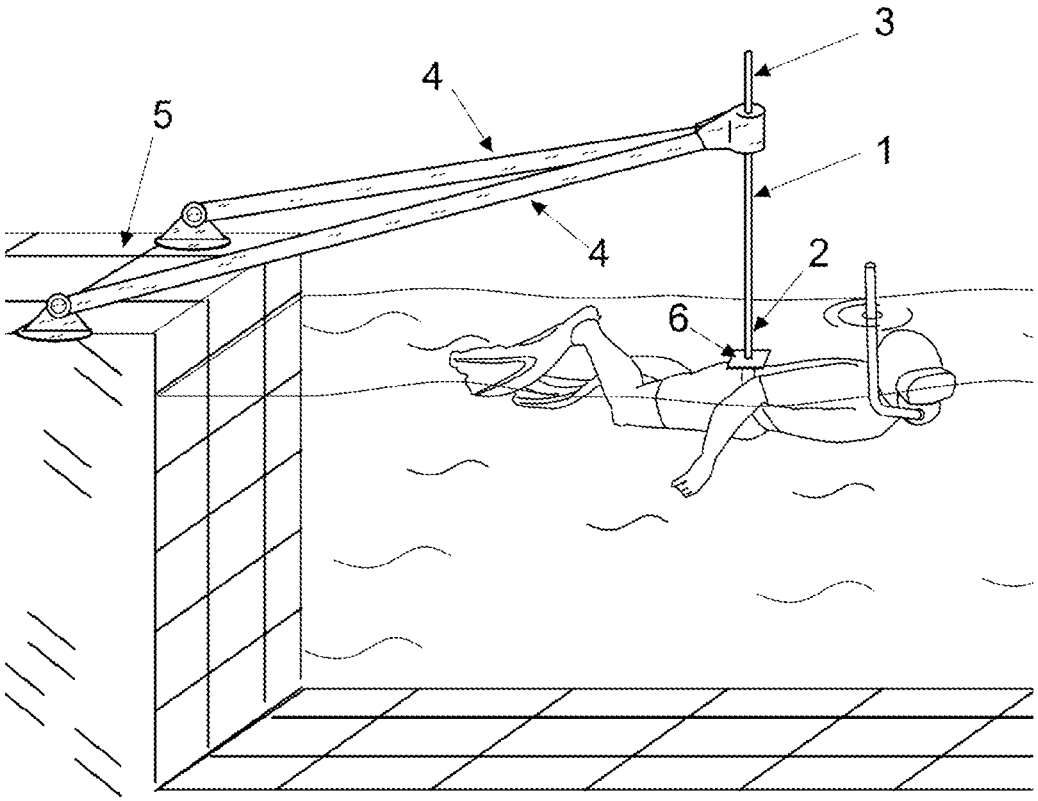
FIG. 5 shows a preferred implementation of the system according to the first embodiment, comprising two spaced apart supports.

A preferred way of implementing the system according to the first embodiment is shown in FIG. 5. The system comprises two inclined supporting members 4, installed at a bearing surface 5 spaced apart from each other and fixedly connected to a resilient member 1 to form a triangular pyramid. Furthermore, the member 4 bearing points are distant from the swimming zone center, and the members 1 and 4 are rotatable around a straight line passing through them. The rigid triangle comprised by the supporting members 4 is rotatable about the bank anchoring axis. The supporting members 4 are disposed relative to each other so as to enhance stability of the structure in the main horizontal operating direction. As a result, a lightweight, quick-detachable and stable structure is produced. Herein, any two attachment points, for example, the swimming pool handrails or side-board, may act as the bearing surfaces. Suction cups may be used for securing the bearing surface 5. To install such structure, only one swimming pool side-board may be utilized, while no other walls or projections are needed; as such, the structure is suitable for large and outdoor swimming pools.

Figure 6:
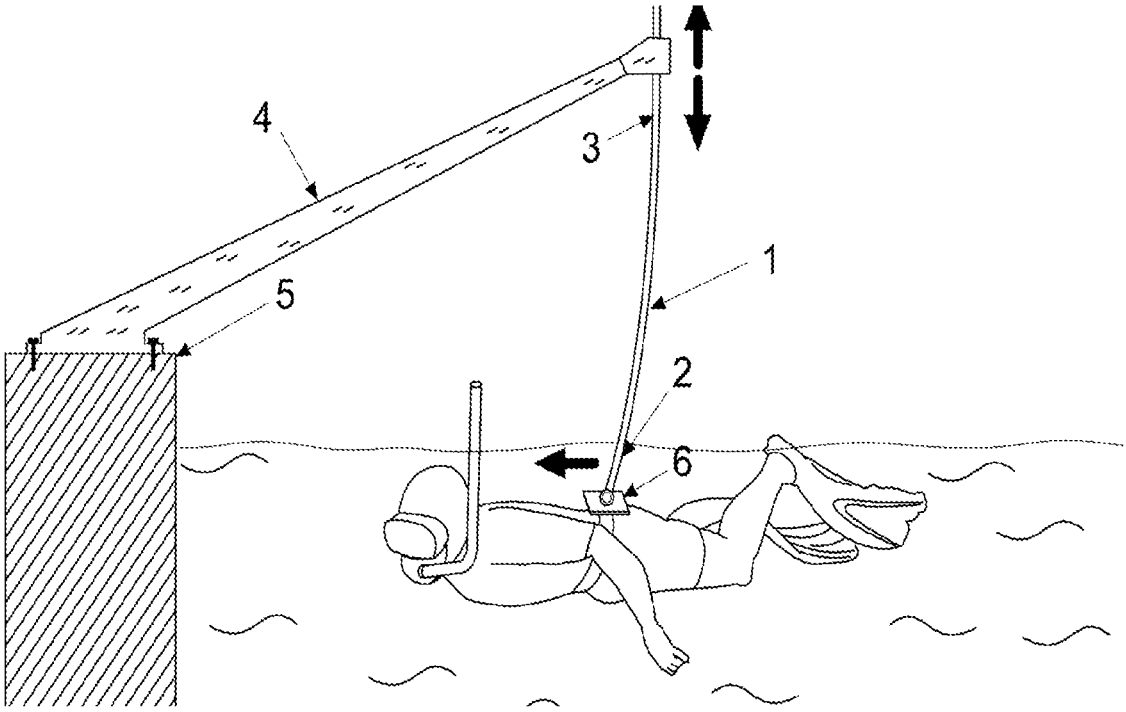
FIGS. 6 to 9 show a second embodiment of the system.
Figure 10:
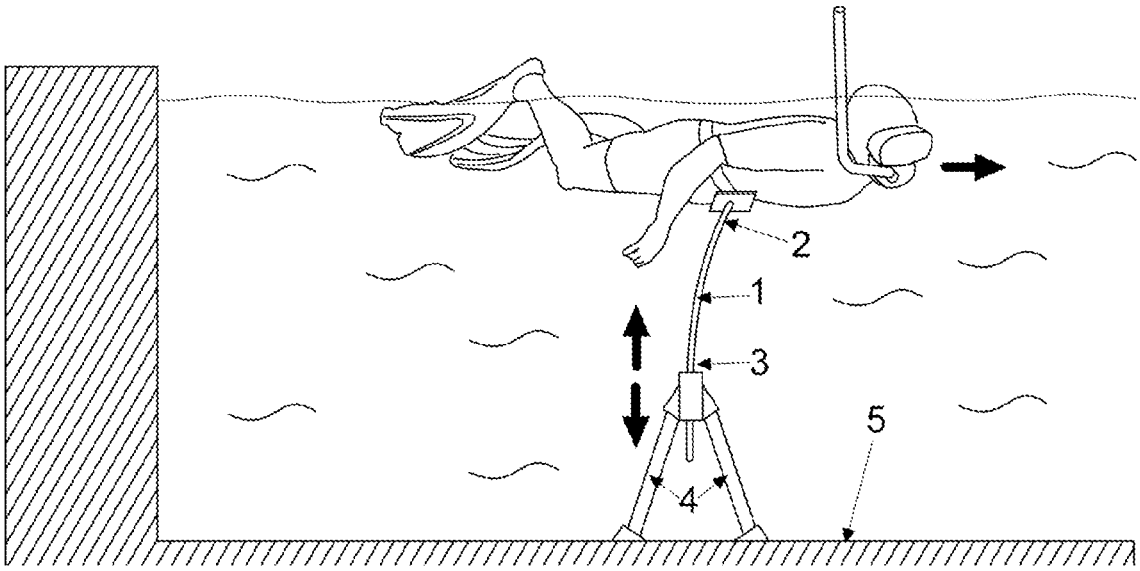
FIG. 10 shows a swimmer anchored to a swimming pool bottom.

In a second embodiment, vertical mobility of a swimmer is provided by a resilient member 1 translationally movable, in response to a swimmer motion, relative to an immovable supporting member 4 (or a system of supporting members 4) at their connection point in an approximately vertical direction. Herein, immobility of the supports at the resilient member 1 anchoring point is provided in various ways. For example, a rigid supporting member/carrier 4 is fixedly anchored and has a sufficient bearing base at the bearing surface 5 (ref. to FIG. 6), the latter may be a swimming pool side-board or bottom (FIG. 10), or an indoor space wall or ceiling. The immobility may also be provided by producing a rigid structure comprised by several supporting members 4 resting upon spaced apart points (for example, at opposite side-boards of the swimming pool) and having their ends connected above the swimming zone center. Such implementation is efficient in cases where it is possible to create, by means of the supporting members, an immovable or substantially immovable point directly above or below the movement zone center.

Figure 7:
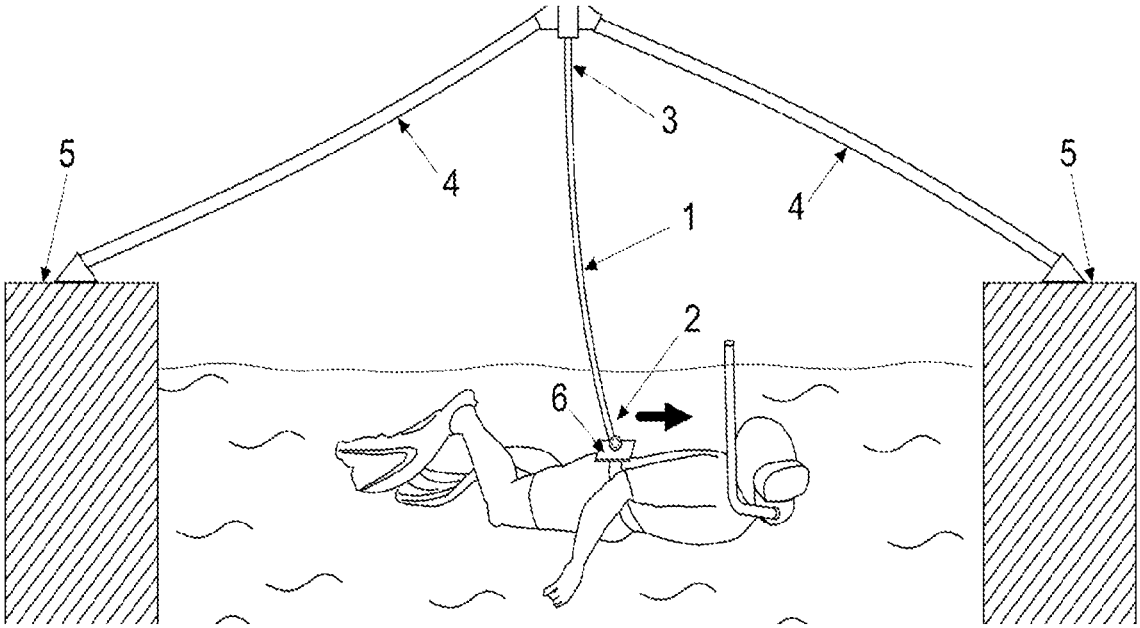
Figure 8:
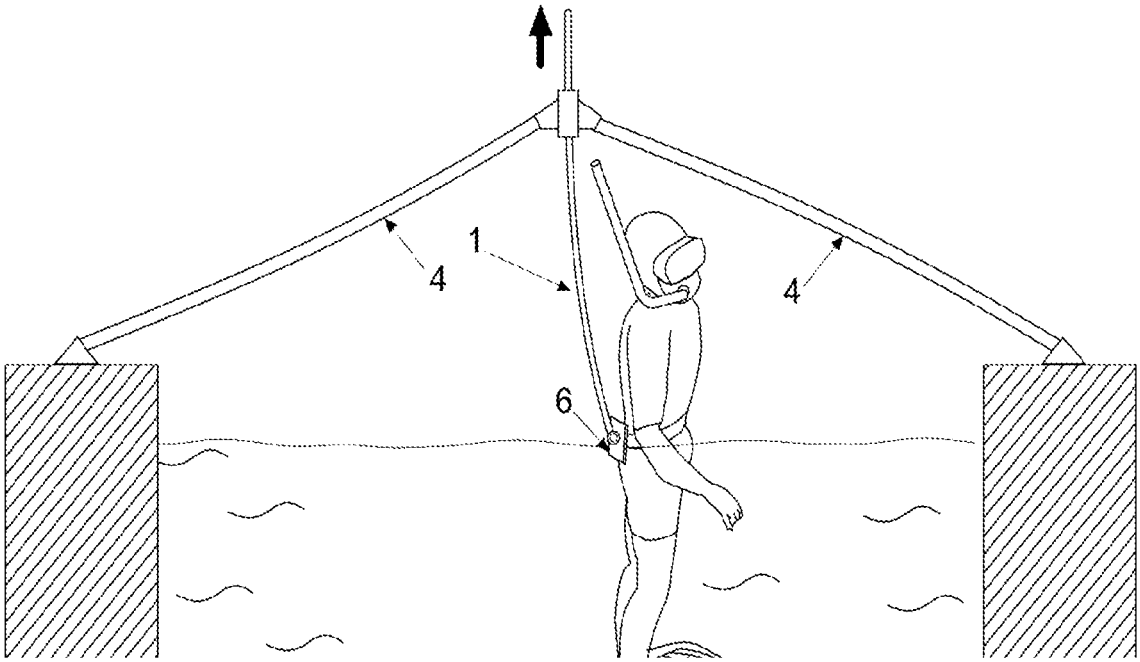
Figure 9:
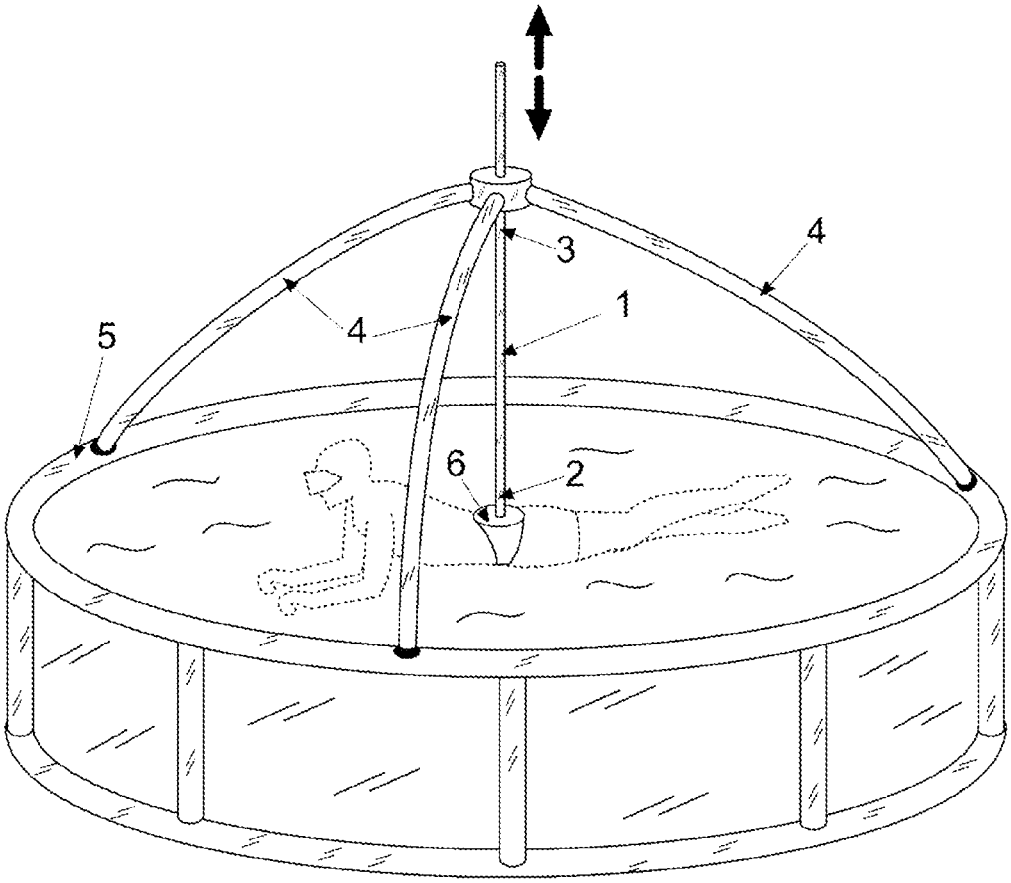

This embodiment may be implemented with the maximum efficiency by using supporting members 4 installed at opposing side-boards (banks) (ref. to FIG. 7, FIG. 8). The supporting members 4 are connected to each other above the water surface to form a 'dome', at the apex of which a resilient member 1 is installed in such a manner that it can translationally move. Such implementation reduces the requirements to the rigidity of supporting member 4 anchoring at the bearing surface 5 and to restriction of their mobility, as they are prevented from rotating by being secured to each other. For small framed swimming pools, it is most preferable to use a system of three or more supporting members 4 (FIG. 9) connected to each other and resting upon distinct points of the swimming pool perimeter, and slidingly connected to the resilient member 1 to provide for the resilient member 1 translation movement in response to the swimmer motions.

The supporting member 4 may be connected to the swimmer directly or via an intermediary element.

The resilient member 1 may be coupled to the swimmer via a module 6 hand-held by the swimmer or secured on the swimmer's body, for example, disposed on a vest. The module 6 may be equipped with hand grips for the swimmer to hold it in two hands in front of him-/herself (ref. to FIG. 11, FIG. 12), thus obviating the need for a swimmer belt or harness. In this way, the process of swimmer preparation for swimming with the use of the system may be simplified. Here, the module may be used as a game controller to simulate, in a virtual reality, the actions of various tools held with both hands (a weapon, a photo camera), thus providing a wider range of gaming scenarios without making the system more complex or adding new monitored devices. Where the module 6 is hand-held, it may be provided with more vertical displacement freedom (as compared with other implementations of the claimed system) to make the module freely movable in front of the user.

Figure 11:
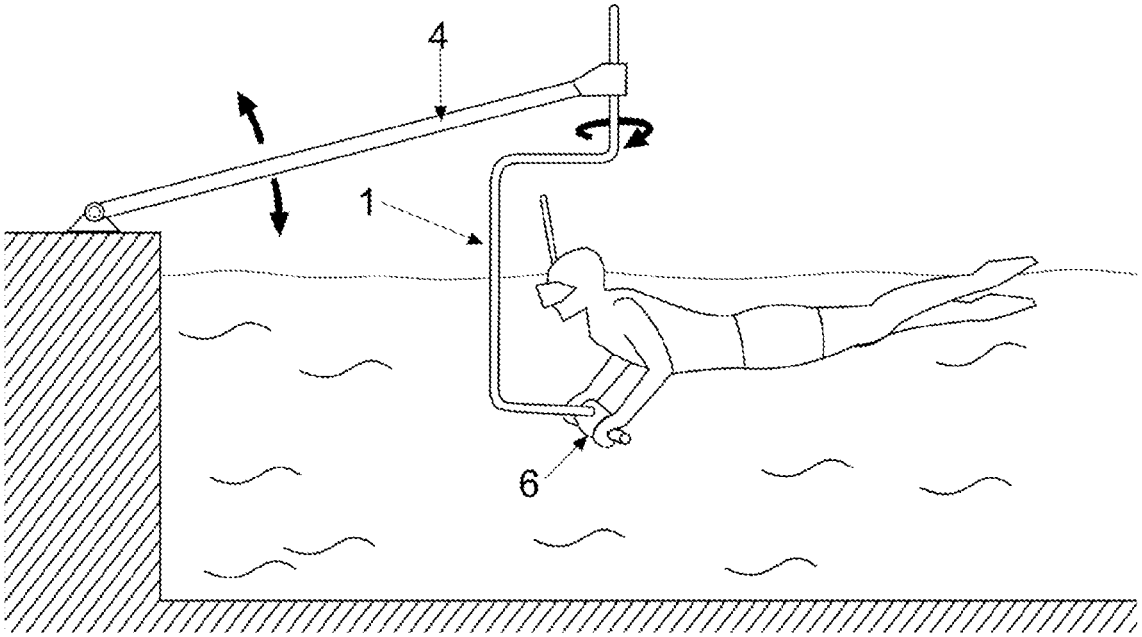
FIGS. 11 to 12 show a curved carrier utilized as a resilient member.
Figure 12:
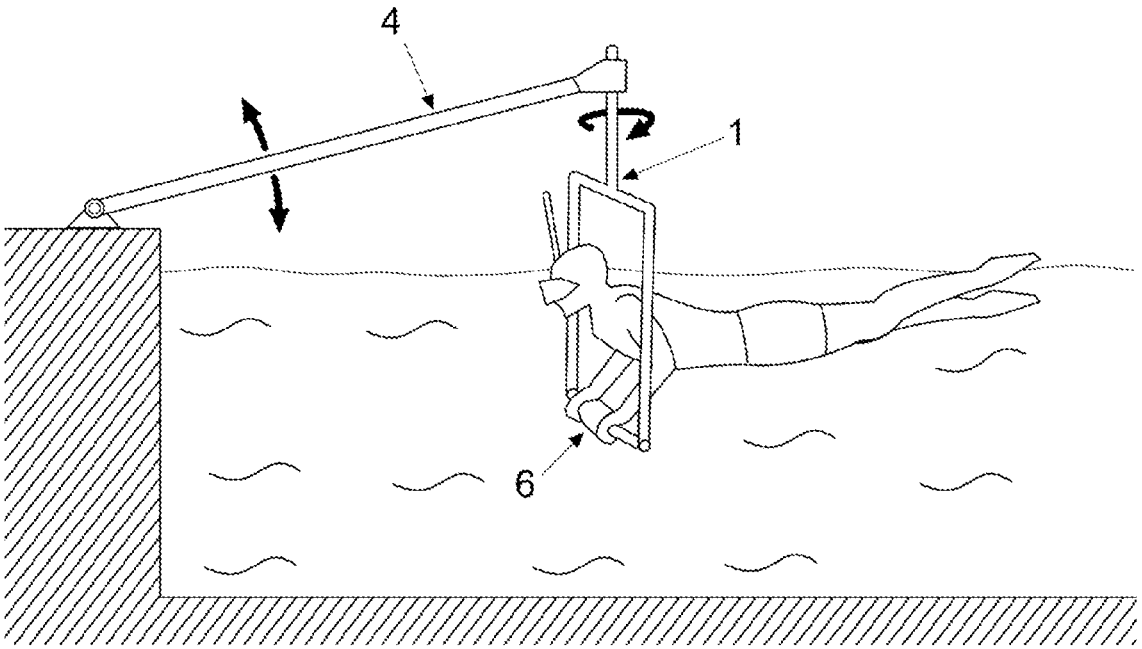

The shape and method of the supporting member 4, resilient member 1 and module 6 connection may be selected such as to provide for the best possible swimmer mobility with a minimum risk of the swimmer colliding with the system components. For example, FIG. 11, FIG. 12 show an implementation of the system, wherein, with a curved shape of the resilient member 1, the swimmer may prevent his/her head and snorkel collision when holding the module 6 in his/her hands. To this end, the resilient member is curved away from the user head at the resilient member 1 portion where the user head could come into contact with the resilient member 1. The resilient member must be freely rotatable about an approximately vertical axis, such that its curvature position be consistent with the user swimming direction. For example, the resilient member 1 may be configured as a C-shaped carrier (FIG. 11) or be trapezoidal (FIG. 12).

Operation of the claimed system will now be described in comparison with the prior art systems utilizing tethers as a member retaining a swimmer and producing a returning force.

When a body secured by means of a flexibly resilient member departs from an equilibrium position, such member produces centrally directed returning forces, the forces increasing with an increase in the departure.

Figure 13:
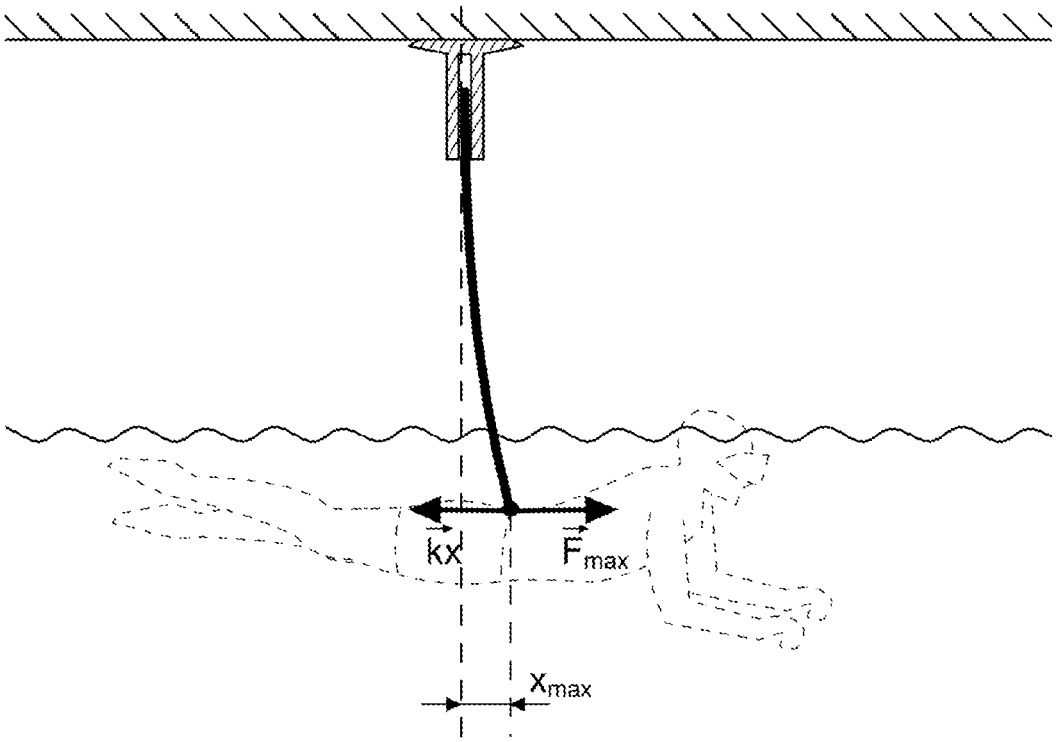
FIG. 13 shows forces acting on a user secured by the resilient member.

FIG. 13 shows the forces exerted on a swimmer, who is retained in a central zone by a resilient member in the form of a resilient curved rod, at the time of the maximum swimmer departure from an equilibrium position in response to applying a maximum swimming force $F_{max}$ in a horizontal direction. Where the resilient member is long enough, as compared with the swimmer displacement, its elastic force tending to return the swimmer to the equilibrium position at this time may be approximately calculated as follows: $k \cdot x_{max}$, where $x_{max}$ is the swimmer displacement relative to the equilibrium point with the maximum force applied, k is the elastic coefficient of the rod. In the above position, the swimmer is stationary, so his/her acceleration is equal to zero, and Newton's second law, projected onto a horizontal axis of displacement, will be written as:

$$F_{max} = k \cdot x_{max} \quad \text{[Mathematical Formula 1]}$$

from which:

$$x_{max} = F_{max}/k \quad \text{[Mathematical Formula 2]}$$

Since the $F_{max}$ value is bounded from above by human physical capabilities, then, by increasing the coefficient k by selecting a more rigid resilient member, an indefinitely small maximum allowable displacement $x_{max}$ may be obtained, thus limiting the minimum allowable size of the zone necessary for swimming.

Figure 14:
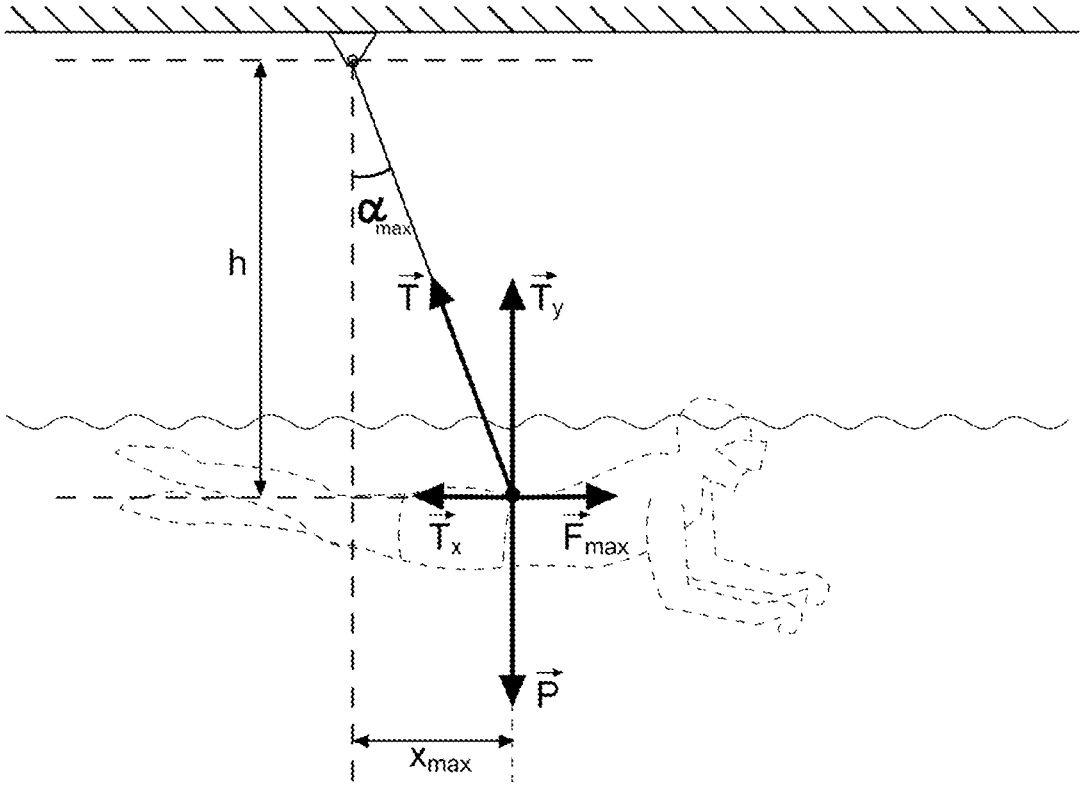
FIG. 14 shows forces acting on a user secured by a suspension device (tether) for comparison.

By way of comparison, FIG. 14 shows the forces acting on a swimmer in response to the swimmer maximum departure from the equilibrium position, when the swimmer is retained by a suspension device (tether). The swimmer also applies the force $F_{max}$ in a horizontal direction. The tether T tension force T is directed towards the tether anchoring point, which is anchored at elevation h departing from the vertical line by an angle $\alpha_{max}$. Let the swimmer negative buoyancy value at the point of maximum departure be equal to P. Then Newton's second law, projected onto the horizontal and vertical axes, will be written as:

$$|F_{max}| = |T_x| \quad \text{[Mathematical Formula 3]}$$

$$|P| = |T_y| \quad \text{[Mathematical Formula 4]}$$

Hence, $$tg(\alpha_{max}) = \frac{|x_{max}|}{|h|} = \frac{|T_x|}{|T_y|} = \frac{|F_{max}|}{|P|} \quad \text{[Mathematical Formula 5]}$$

From which $$|x_{max}| = |h| \cdot \frac{|F_{max}|}{|P|} \quad \text{[Mathematical Formula 6]}$$

Thus, $x_{max}$ at a given elevation of the tether (suspension device) anchoring point and the maximum swimmer force $F_{max}$ may only be reduced by increasing his/her negative buoyancy value (by adding more weight), which is significantly disadvantageous in various ways. First, a large additional weight is disadvantageous in that it increases the load on and the requirements to the tether (suspension device) anchoring point. Second, negative buoyancy increases the risk of accidents in the event of tether breakage. Third, such added mass will add to inertia during the swimmer movements, either translational, or rotational. As such, in practice, it is reasonable to provide anchoring by means of an overhead tether, in case where the user buoyancy is close to neutral. In this event, buoyancy only starts to decrease when the user departs in such a manner that he/she is partially lifted from the water (then, if the weight is unchanged, the Archimedes force starts to decrease). Otherwise, until an angle is reached, at which the tether starts lifting the user out of the water, no forces are exerted on the user by the tether in a horizontal direction, thus resulting in the above-described jerking effect in response to a load applied to the tether.

In this way, by using a resilient retaining member, the necessary water body surface area, specifically, that of a simulation zone, may be reduced, and a more uniform distribution of forces may be obtained.

The invention claimed is:

1. A system for restricting user movements in an aquatic medium, the system comprising a flexibly resilient member, having a first end designed to be connected to a user and a second end designed to be anchored by means of a system of supports such:

as to allow the resilient member to move in its entirety, without being deformed, in such a manner that elevation of the resilient member end, designed to be connected to the user, varies as the user position depth varies when swimming along the water surface;

that any substantial displacement of the user in any horizontal direction causes the resilient member to flex, wherein the system of supports is disposed to rotationally move about an approximately horizontal axis distant from a swimming zone center, wherein the resilient member end, designed to be anchored by means of the system of supports, is fixedly connected to the ends of two inclined supports, the supports having their opposite ends anchored at spaced apart points distant from the swimming zone center, such that the supports and the resilient member are rotatable relative to a straight line passing through the support anchoring points.

2. The system of claim 1, wherein the resilient member is disposed to translationally move along an approximately vertical axis.

3. The system of claim 2, wherein the resilient member is slidingly coupled to a system of at least two supports resting on distinct points distant from the swimming zone center.

4. The system of claim 1, wherein the resilient member is designed to be connected to the user via a module secured on the user's body or hand-held by the user.

5. The system of claim 1, wherein the resilient member is connected to the user via an intermediary element providing for the user rotational mobility about the resilient member.

6. The system of claim 1, wherein the system is used for virtual reality simulation systems.

7. A system for restricting user movements in an aquatic medium, the system comprising a flexibly resilient member, having a first end designed to be connected to a user and a second end designed to be anchored by means of a system of supports such:

as to allow the resilient member to move in its entirety, without being deformed, in such a manner that elevation of the resilient member end, designed to be connected to the user, varies as the user position depth varies when swimming along the water surface;

that any substantial displacement of the user in any horizontal direction causes the resilient member to flex, wherein the system of supports is disposed to rotationally move about an approximately horizontal axis distant from a swimming zone center, wherein the resilient member is designed to be connected to the user via a module secured on the user's body or hand-held by the user, and wherein the module is designed to be hand-held by the user, and the resilient member is curved away from the user head at an area corresponding to the user head level and is freely rotatable about an approximately vertical axis.

* * * * *